US008428942B2

(12) United States Patent
Jax et al.

(10) Patent No.: US 8,428,942 B2
(45) Date of Patent: Apr. 23, 2013

(54) METHOD AND APPARATUS FOR RE-ENCODING SIGNALS

(75) Inventors: Peter Jax, Hannover (DE); Oliver Wuebbolt, Hannover (DE); Johannes Boehm, Goettingen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1199 days.

(21) Appl. No.: 12/227,189

(22) PCT Filed: May 12, 2007

(86) PCT No.: PCT/EP2007/054289

§ 371 (c)(1),
(2), (4) Date: Nov. 10, 2008

(87) PCT Pub. No.: WO2007/131886

PCT Pub. Date: Nov. 22, 2007

(65) Prior Publication Data

US 2009/0106031 A1 Apr. 23, 2009

(30) Foreign Application Priority Data

May 12, 2006 (EP) ..... 06113867

(51) Int. Cl.
*G10L 19/00* (2006.01)
*G10L 19/02* (2006.01)

(52) U.S. Cl.
USPC ..... 704/230; 704/229; 704/500

(58) Field of Classification Search ..... 704/229, 704/230, 500
See application file for complete search history.

(56) References Cited

U.S. PATENT DOCUMENTS

| | | | | |
|---|---|---|---|---|
| 6,023,233 | A * | 2/2000 | Craven et al. | 341/51 |
| 6,108,625 | A * | 8/2000 | Kim | 704/229 |
| 6,115,688 | A * | 9/2000 | Brandenburg et al. | 704/503 |
| 6,134,523 | A | 10/2000 | Nakajima et al. | |
| 6,829,579 | B2 * | 12/2004 | Jabri et al. | 704/221 |
| 6,970,479 | B2 * | 11/2005 | Abrahamsson et al. | 370/477 |
| 7,099,523 | B2 * | 8/2006 | Martens et al. | 382/300 |

(Continued)

FOREIGN PATENT DOCUMENTS

EP 1274070 1/2003

OTHER PUBLICATIONS

A. Jin et al: "Scalable audio coder based on quantizer units of MDCT coefficients" Acoustics, Speech and Signal Processing 1999, Proceedings 1999 IEEE Int'l Conf., Mar. 15-19, 1999, vol. 2, pp. 897-900, XP010328465.

(Continued)

*Primary Examiner* — Paras D Shah
(74) *Attorney, Agent, or Firm* — Tutunjian & Bitetto, P.C.

(57) ABSTRACT

At the time of encoding audio content, the finally required data rate for delivery to the customer may be unknown. A data format is disclosed that is optimized for serving as Intermediate Format for efficient and fast recoding, to obtain one or more standard complying lossy encoded data streams with flexible data rates. Encoding can be performed in two steps that are inter-coordinated for cooperating, but may be locally and/or temporally separate. Between the partial encoders encoding parameters and/or auxiliary data are transmitted in a separate parameter enhancement layer, which complements a lossy data stream and can be used by the second encoder or transcoder for fast and computationally efficient implementation of the second encoding step. An additional lossless enhancement layer allows lossless reconstruction.

6 Claims, 5 Drawing Sheets

U.S. PATENT DOCUMENTS

| | | | | |
|---|---|---|---|---|
| 7,275,031 | B2 * | 9/2007 | Hoerich et al. | 704/230 |
| 7,327,287 | B2 * | 2/2008 | Martinian et al. | 341/51 |
| 7,343,287 | B2 * | 3/2008 | Geiger et al. | 704/230 |
| 7,835,904 | B2 * | 11/2010 | Li et al. | 704/200.1 |
| 7,937,272 | B2 * | 5/2011 | Oomen et al. | 704/500 |
| 8,032,367 | B2 * | 10/2011 | Takamizawa | 704/229 |
| 2002/0034376 | A1 * | 3/2002 | Katayama et al. | 386/96 |
| 2003/0125939 | A1 * | 7/2003 | Zinser et al. | 704/219 |
| 2003/0171919 | A1 | 9/2003 | Kim et al. | |
| 2003/0202579 | A1 | 10/2003 | Lin et al. | |
| 2004/0165667 | A1 | 8/2004 | Lennon et al. | |
| 2005/0163323 | A1 * | 7/2005 | Oshikiri | 381/22 |
| 2007/0003057 | A1 * | 1/2007 | Lemma et al. | 380/200 |
| 2008/0260048 | A1 * | 10/2008 | Oomen et al. | 375/241 |

OTHER PUBLICATIONS

M. Hans et al: "An MPEG Audio Layered Transcoder", Preprints of Papers Presented at the AES Convention, Sep. 1998, pp. 1-18, XP001014304.

Search Report Dated Jul. 18, 2007.

* cited by examiner a)

b)

c)

d)

METHOD AND APPARATUS FOR RE-ENCODING SIGNALS

This application claims the benefit, under 35 U.S.C. §365 of International Application PCT/EP2007/054289, filed May 3, 2007, which was published in accordance with PCT Article 21(2) on Nov. 22, 2007 in English and which claims the benefit of European patent application No. 06113867.3, filed May 12, 2006.

FIELD OF THE INVENTION

This invention relates to a method and an apparatus for encoding audio data, and to a method and an apparatus for re-encoding or transcoding audio data, and a respective audio data format.

BACKGROUND

Today's trend in media broadcasting/streaming is that the transport channels become more and more heterogeneous. Content providers and broadcasters continuously loose control of parts of the distribution chain. Thus, at the time of encoding audio content it may not be known at which data rate the content can be delivered to the customer.

The following solutions have been proposed or are used to tackle the problem today.

Usually, the content is encoded with a data rate that is corresponding to a worst-case transmission scenario. That is, the data rate is specified such that it reflects the maximum possible data rate expected to be deliverable to all of the customers. This has the disadvantage that most of the customers suffer from quality degradation although the transmission capacities would be better than worst case for them.

A better solution is to provide the same content at a selection of different data rates, i.e. several streams of the same content, each encoded with a different data rate.

Thus, the customer can select the version matching the specific quality demand and channel capacity, as used e.g. in Internet streaming. However, a significant part of the data is identical in each channel, so that much bandwidth is required for transmitting redundant data. As another drawback, the customer or decoder has to find and select the channel with the applicable data rate.

Another option is to apply transcoding of the content within the transmission chain. One example is to encode the content with a rather high data rate in a first step, and apply transcoding techniques at a later time if the data rate exceeds the actual transmission capacity. However, transcoding usually requires decoding and re-encoding, and leads therefore often to data quality degradation, e.g. by distortion, that is inherent to encoding and decoding processes. The quality degradation caused by this kind of transcoding comes additional to the quality degradation of the initial encoding. Further, these processes are computationally complex and require significant processing power at the points of transcoding.

In some solutions, there is a feedback from the customer to the encoding process, e.g. in adaptive multi-rate (AMR) speech coding. For practical broadcasting applications this approach is unusable since feedback control loops cannot be extended to a large number of users. Moreover, the feedback controls the complete, computationally complex encoding process, which is disadvantageous for off-line content, as e.g. in non real-time transmission.

Other solutions use bit stream scalability, like e.g. MPEG-4 Scalable-to-Lossless (SLS). Though current scalable approaches are specifically tailored for the targeted scenarios, they are in general not backwards compatible to previous standards, so that the customer needs a specific decoder to exploit the scalable portion of the signal. A conventional decoder can decode only the basic part of the signal, e.g. of an MPEG SLS data stream. Further, there is a quality penalty owing to the scalable bit stream format at least for some of today's scalable approaches. In particular, for the popular MPEG-1 Layer III (mp3) format no scalable approach is known.

SUMMARY OF THE INVENTION

One problem to be solved by the invention is to provide a coding scheme that allows transcoding of a bit stream to various different data rates. In particular, the coding scheme shall provide higher efficiency than known solutions, and transcoding to other data rates at a later time shall be possible.

The present invention is based on a hierarchical coding principle, and provides a very flexible intermediate coding format. The gross bit stream of the coding format comprises at least two sub-streams: one bit stream of an embedded backwards compatible and lossy coding format (e.g. mp3 in the case of audio), and an information layer bit stream, which is called Parameter Enhancement Layer (PEL) herein.

When re-encoding the data, the information layer data can be used to obtain a new bit stream that is compliant to the embedded lossy format, but has a different data rate than the embedded lossy part of the bit stream.

The term "lossy" is used herein in a strict sense, e.g. we denote as a "lossy audio coding format" any audio coding scheme that does not bit-exactly reproduce the original PCM samples of the audio signal at the decoder. Nevertheless, also "perceptually lossless" codecs (i.e. a human listener cannot perceive any difference between the decoded signal and the original signal) are often denoted as "lossy".

In one embodiment of the invention, there is another layer on top of the PEL that contains data for achieving mathematically lossless decoding. It is called Lossless Enhancement Layer (LEL) herein. The source signal, for example PCM samples, can be mathematically lossless decoded from the lossy encoded bit stream together with the LEL.

One aspect of the invention is to provide an encoding scheme that allows recoding operations with the smallest possible computational complexity. This means that not necessarily the maximum coding efficiency (i.e. compression ratio) is achieved. Thus, an audio format according to the invention is well suited for a wide range of broadcasting and storage applications.

Note that though the invention is described for the example of mp3 compliant parts in the bit streams as an example of lossy audio coding, the same principles can be applied in conjunction with other audio/speech coding formats.

According to one aspect of the invention, a method for encoding a source signal comprises the steps of encoding the source signal into a first data stream using a lossy encoding method, eq. Advanced Audio Codec (AAC) or mp3, wherein the encoding method comprises the steps of determining parameters and quantizing the determined parameters, and wherein for the quantizing a bit allocation algorithm is used to meet a given data rate or enable decoding of the first data stream at a given quality level, and wherein the quantized determined parameters are included in the first data stream, encoding additional information into a second data stream, e.g. PEL, wherein the additional information is not necessary for lossy decoding of the first data stream at said given data rate or quality level (because the first data stream is self-contained), and comprises at least finely quantized representations of the parameters determined by said lossy encoding method. Further, it may contain finely quantized time-domain signals.

In one embodiment of the invention said lossy encoding method works in the frequency domain, and the finely quantized parameters comprised in said additional information of the second data stream include coefficients of a Modified Discrete Cosine Transform (MDCT).

In one embodiment of the invention the method further comprises the step of encoding further additional information into a third data stream, eq. LEL, wherein the further additional information contains differential time-domain information that enables lossless reconstruction of the source signal based on the first and second data stream.

According to one aspect of the invention, a method for transcoding (actually it is re-encoding) a signal that comprises at least a first and a second data stream, wherein the first data stream is self-contained and comprises a lossy encoded source signal and side information, and wherein quantized parameters used for the encoding of the lossy encoded source signal are included in the first data stream, and data describing the quantization process by which said quantized parameters were obtained are included in said side information, comprises the steps of extracting from the first data stream the lossy encoded source signal and said side information, extracting from the second data stream additional information comprising at least conditionally fine quantized representations of (some or all of) the parameters used for the encoding of the lossy encoded source signal, and additional side information, decoding the parameters included in the extracted lossy encoded source signal, whereby decoded coarsely reconstructed parameters are obtained, conditionally decoding some or all of the additional information, at least said conditionally fine quantized representations of the parameters used for encoding, wherein the decoded coarsely reconstructed parameters are used and decoded finely reconstructed parameters are obtained, decoding said side information extracted from the first data stream, decoding said additional side information extracted from the second data stream, and re-quantizing and re-encoding the decoded finely reconstructed parameters, wherein a bit allocation algorithm is used that is controlled according to the decoded side information, the decoded additional side information and a required data rate, wherein an encoded output signal and output side information are generated.

Advantageously, the encoded output signal and output side information (e.g. after a time-multiplex) comply with the same encoding format as said lossy encoded source signal and said side information, with only different data rates. One example is re-encoding mp3 formatted data from a lower bit-rate (e.g. 64 kbps) to a higher bit-rate (e.g. 320 kbps), another is re-encoding an MPEC-4 SLS bit stream to AAC formatted audio data.

In one embodiment of the invention the additional information within the second data stream further comprises intermediate encoding parameters of the lossy encoding method.

In one embodiment of the invention the parameters within the additional information of the second data stream are conditionally encoded relative to the encoding parameters of the first data stream. One example for conditional encoding is differential encoding.

Due to the adaptive bit allocation, the parameters within the additional information of the second data stream (i.e. PEL) may vary among encoding units (e.g. blocks, frames) of the data stream.

According to one aspect of the invention, an apparatus for encoding a source signal comprises first encoder for lossy encoding of the source signal into a first data stream (e.g. AAC or mp3), wherein the first encoder comprises means for determining parameters and means for quantizing the determined parameters, wherein the means for quantizing comprises means for performing a bit allocation algorithm to meet a given data rate or enable decoding of the first data stream at a given quality level, and wherein the quantized determined parameters are included in the first data stream, and means for encoding additional information into a second data stream, wherein the additional information is not necessary for decoding of the lossy encoded first data stream at said given data rate or quality level, and the means comprises at least means for generating finely quantized representations of the parameters determined by the means for determining parameters.

In one embodiment of the invention the apparatus further comprises means for encoding further additional information into a third data stream (e.g. LEL), wherein the further additional information contains differential time-domain information that enables lossless reconstruction of the source signal from the first data stream.

According to one aspect of the invention, an apparatus for transcoding a signal that comprises at least a first and a second data stream, wherein the first data stream is self-contained and comprises a lossy encoded source signal and side information, and wherein quantized parameters used for the encoding of the lossy encoded source signal are included in the first data stream and data describing the quantization process by which said quantized parameters were obtained are included in said side information, comprises means for extracting from the first data stream the lossy encoded source signal and said side information, means for extracting from the second data stream additional information, the additional information comprising at least fine quantized representations of the parameters used for the encoding of the lossy encoded source signal, and additional side information, means for decoding the parameters included in the extracted lossy encoded source signal, whereby decoded coarsely reconstructed parameters are obtained, means for conditionally decoding from the additional information at least said conditionally fine quantized representations of the parameters used for encoding, wherein the coarsely reconstructed parameters are used and finely reconstructed parameters are obtained, means for decoding said side information extracted from the first data stream, means for decoding said additional side information extracted from the second data stream, means for generating control information according to the decoded side information, the decoded additional side information and a required data rate, and means for re-quantizing and re-encoding the decoded finely reconstructed parameters, wherein a bit allocation algorithm is used that is controlled by said control information, wherein an encoded output signal and output side information are generated.

According to one aspect of the invention, an extension data stream is provided for a lossy encoded self-contained first data stream, wherein the lossy encoded self-contained first data stream comprises first quantized representations of encoding parameters. Said extension data stream comprises at least second quantized representations of the encoder parameters of the lossy data stream, wherein the second quantized representations of the encoding parameters are finer quantized than the first quantized representations of the encoding parameters.

The quantized parameters of the second data stream may also comprise intermediate parameters coming from the encoding process of said lossy encoded first data stream, and/or intermediate parameters that are pre-computed for usage in a transcoding process of said lossy encoded first data stream into a lossy encoded target data stream.

Further, according to another aspect of the invention, the extension data stream may comprise a further layer (denoted as LEL) containing at least conditionally encoded signals representing the difference between the lossy encoded first data stream and its original source data stream, wherein the difference is expressed in time-domain data. This further layer will only be used for lossless decoding, i.e. re-generating the original source data stream losslessly, and in this case (some of) the above-mentioned fine quantized parameters of the extension layer are usually not needed. However, since the main purpose of the invention is to enable easy transcoding from a lossy format to another lossy format with minimum quality degradation, and lossless decoding is only regarded as an add-on, the extension data stream will always include the fine quantized parameters of the PEL.

Advantageous embodiments of the invention are disclosed in the dependent claims, the following description and the figures.

BRIEF DESCRIPTION OF THE DRAWINGS

Exemplary embodiments of the invention are described with reference to the accompanying drawings, which show in FIG. 1 a three-layered hierarchical bit stream, and possible operations to be applied;

FIG. 5 an MPEG-1 layer III encoder with hierarchical add-on;

FIG. 6 an MPEG-1 layer III re-encoder with hierarchical add-on;

FIG. 7 encoder signal flow of an MPEG-1 Layer-III encoder with hierarchical add-on.

DETAILED DESCRIPTION OF THE INVENTION

Figure 1:
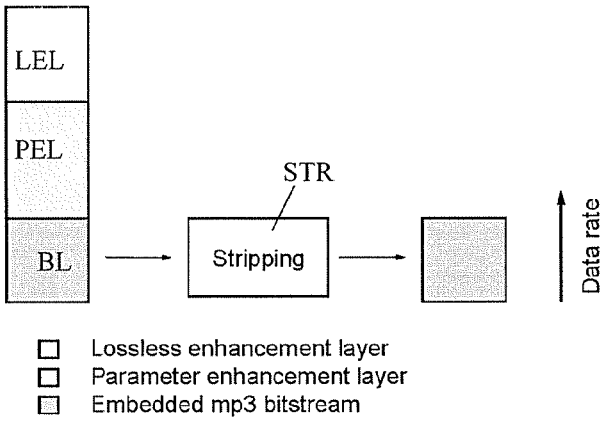
Figure 1:
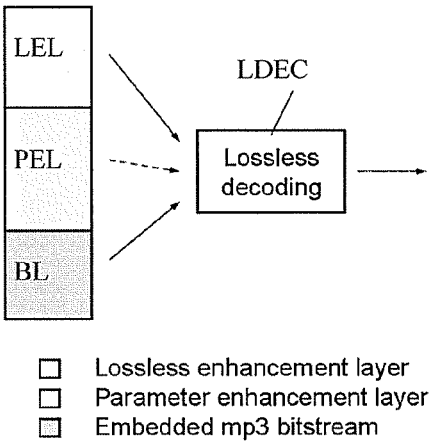
Figure 1:
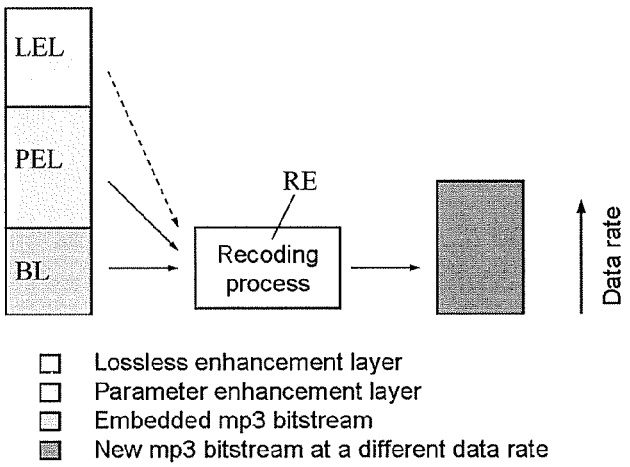
Figure 1:
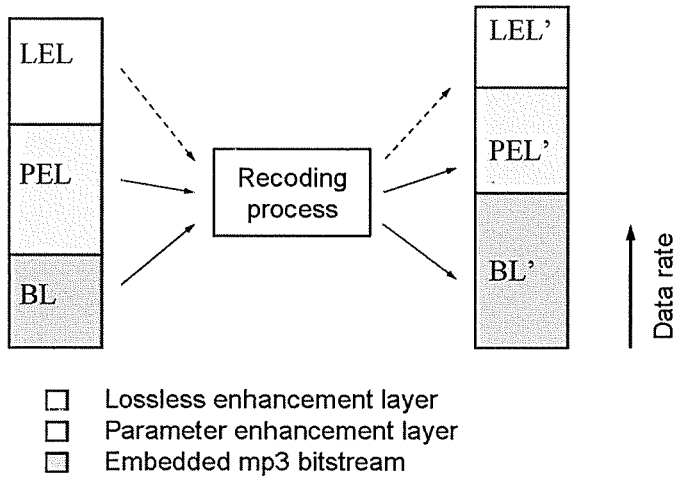

FIG. 1 shows a three-layered bit stream format according to the invention, and different operations that can be applied to it. This format is particularly well-suited for transcoding (or rather re-encoding) and is therefore called "Intermediate format" herein. The term transcoding would not be precise in this context, regarding the usual use of the term in literature. Instead, the proposed re-coding operation is different from conventional transcoding in the respect that it is not only based on the lossy bit stream, but uses additional information as well.

Further, the invention principle is explained using the example of audio coding, where mp3 compliant parts are comprised in the bit streams as an example of lossy audio coding. Nevertheless, the same principles can be applied in conjunction with other audio/speech coding formats. The Intermediate format is optimized for two major goals: one (the more important) is to enable easy transcoding from one lossy format to another lossy format (or rather the same lossy format at another data rate or quality level) with minimum quality degradation, and another is to enable lossless decoding/transcoding of the source signal.

The bit stream of the proposed intermediate audio format is hierarchical and consists in the present example of the following three layers:

A first layer that is called base layer BL comprises an embedded lossy coding format, e.g. conforming to the mp3 standard. Other audio examples for this layer are AAC or a speech coding format. This part of the bit stream may also contain additional metadata like ID3 tags, synchronization information etc.

The second layer is a parameter enhancement layer PEL and contains information that is useful for very fast recoding of the embedded lossy bit stream. This information may comprise pre-computed and finely quantized representations of the codec parameters of the embedded lossy format, or intermediate parameters needed for the (preceding) encoding process or the (coming) transcoding process.

For example if the embedded lossy coding format is mp3 compliant, this layer of the hierarchical bit stream may contain finely quantized representations of the sub-band signals or MDCT transform coefficients. It may also contain some or all of the following: information about the optimal choice of frame sizes and windows, auxiliary information to be used for determining psychoacoustic masking thresholds, scale factors, bit allocations etc., parameters to be used for advanced coding tools like parametric stereo, spectral band replication (SBR) etc.

Some of this information may also be extracted (partly) from the base layer bit stream (e.g. in the case of mp3). That is, the second layer is not self-contained (it is useless without the base layer) and may contain conditional information building on information that is contained already in the base layer.

An optional third layer called Lossless Enhancement Layer LEL of information is needed for mathematically lossless decoding of the original pulse-code modulation (PCM) samples of the audio signal. It may contain for example differential time-domain information. Decoding of this layer requires knowledge of either the base layer BL, or of the parameter enhancement layer PEL, or of both layers of the hierarchical bit stream. The third layer LEL is only required for lossless (ie. bit-exact) reconstruction of the source signal. In this case however some or all information from the parameter enhancement layer PEL is not required.

Also the third layer is not self-contained. In fact it can be regarded as part of a single extension layer that comprises at least the PEL, and optionally also the LEL. However, each of the layers PEL,LEL that are on top of the base layer BL must be transmitted and decoded completely, if at all. The LEL can be ignored, as described below.

Any of these layers BL,PEL,LEL and the total bit stream can have variable bit rate (VBR) or constant bit rate (CBR). In the mp3 example, the lossless encoded signal with three layers may have typically 40-60% of the data rate of the original PCM source signal (on average, since each frame has its individual data rate), depending on the audio content. Further, an Intermediate Format with two layers BL,PEL that is encoded with the intention to enable re-encoding to the maximum specified mp3 data rate of 320 kbit/s will in total have at least these 320 kbit/s, and few additional overhead (neglectible, e.g. 2 kbit/s). The Intermediate Format with two layers BL,PEL may however also be encoded at lower data rates, but then the maximum data rate that is achievable by re-encoding is correspondingly lower. It may however also be encoded at higher data rates (i.e. BL+PEL>maximum data rate specified for the BL), which is advantageous for further reducing the quantization error variance of the PEL, and thus of the final signal.

In some applications (e.g. decoding) it may be possible to omit the LEL or also parts of the PEL. However, for transcoding the lossy formatted signal BL to another lossy output format, usage of the second layer is mandatory for the invention: regardless whether the lossy output format has higher or lower bandwidth than the lossy input format, it is advantageous to use the PEL data, because the quantization errors of the previous quantization for BL and of the quantization that is included in the transcoding will accumulate, which deteriorates the transcoded signal.

The fine quantized parameters of the PEL are afflicted with much lower quantization error, and therefore enable a quality of the transcoder output signal that is comparable to the quality of a signal that was directly encoded from the source signal.

FIG. 1 *a*) shows an example where the embedded base layer BL signal is decoded or further distributed at its normal data rate, and thus the extension layer can be ignored. Only the base layer BL is stripped off the signal for access, and can be conventionally decoded and reproduced or further distributed at its original data rate. In principle, this stripping process STR consists of separating the base layer BL data from all other data included in the Intermediate Format bit stream.

If the LEL is not required, a similar stripping operation can be applied on a full lossy base layer BL with parameter enhancement layer PEL and lossless enhancement layer LEL description, to obtain a lossy base layer BL plus parameter enhancement layer PEL representation of the content.

For lossless decoding of the original PCM samples, as shown in FIG. 1 *b*), all three layers may be interpreted and decoded. The dashed line in FIG. 1 *b*) from the PEL to the lossless decoder LDEC illustrates that not all information from the PEL may be necessary for this operation.

FIG. 1 *c*) shows an example for transcoding or recoding. The information contained in the PEL is prepared in a format that is optimized for transcoding (i.e. the re-encoder RE can use very simple operations for re-encoding) and allows to produce a new bit stream that is compliant to the embedded lossy format (mp3 in this example), yet with any other desired data rate. The new data rate is not constrained by the data rate of the original lossy part BL of the embedded bit stream, but by the gross data rates of the embedded lossy bit stream and the parameter enhancement layer PEL. That is, the data rate of the new bit stream may be lower or higher than the data rate of the original embedded lossy bit stream BL.

Since the parameter enhancement layer PEL contains preconditioned and pre-computed information to be used in the recoding operation, only very low computational effort is necessary in the transcoder for re-encoding, while the basic format remains unchanged.

The coding efficiency (ie. data rate versus distortion) of the transcoded lossy bit stream is comparable to the coding efficiency of a similar bit stream as produced by a stand-alone lossy encoder operating on the original PCM samples of the signal. That is, the proposed concept allows for a very scalable and flexible data format, but without the degradations usually accompanied with today's bit stream scalable audio coding approaches, like MPEG-4 SLS (scalable to lossless), which requires additional overhead for each of its various extension layers.

FIG. 1 *d*) shows exemplarily how, in an extended manner as compared to FIG. 1 *c*), by this recoding operation a new hierarchical bit stream can be produced that contains a lossy bit stream BL' at a different data rate than the lossy input bit stream BL. In addition to the steps from FIG. 1 *c*, the parameter enhancement layer PEL' and optionally the lossless enhancement layer LEL' are rebuilt on top of the recoded embedded lossy bit stream. The output signal can in this case be further treated as described for FIG. 1 *a*)-*c*), ie. it is suitable for further distribution, stripping, lossy decoding, lossless decoding and/or further transcoding.

Advantageously, in the examples of FIG. 1 *a*)-*d*) the output signal complies fully with the mp3 standard and can be decoded by conventional mp3 decoders.

Note that the lossless enhancement layer LEL is only necessary for the lossless decoding operation of FIG. 1 *b*). The other operations can as well be performed with a bit stream that contains no lossless extension layer LEL.

As described above, at the time of encoding a particular content it may be unknown at which data rate the content can be delivered to the customer. Advantageously, the disclosed coding scheme allows for very efficient transcoding of the bit stream to a selection of different data rates at a later time. The hierarchical Intermediate Coding Format with easy/fast recoding capability offers a much more flexible manner to tackle such heterogeneous scenarios.

Figure 2:
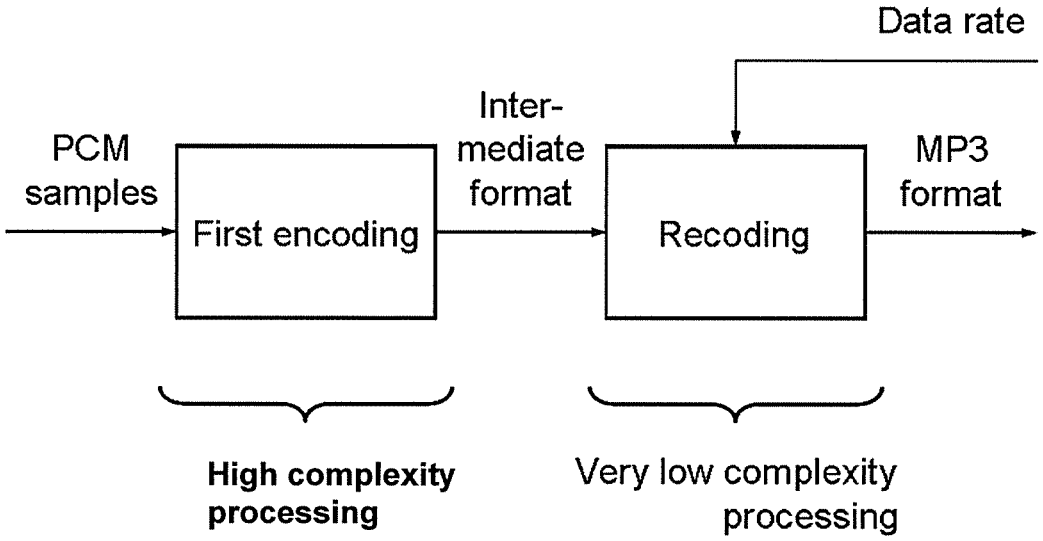
FIG. 2 fast recoding for late decision on the final data rate.

The principle of the encoding and re-encoding process is shown in FIG. 2. The encoding process is divided into two distinct steps, which may be performed in different locations and at different times, using the proposed hierarchical coding format as an intermediate format. The first encoding step FE may be performed off-line or in an environment in which large computational capacity is available. The result IF of this first encoding is a hierarchical representation of the signal according to the Intermediate Format according to the invention. This format allows for a very efficient recoding of the signal to the final desired format and data rate at any later time or in an environment with very limited computational power. That is, the Intermediate Format shown in FIG. 2 may be delayed, transmitted, stored etc. before entering the recoding block RE. Further, the same intermediate representation may be used to recode the content for many different customers in parallel, i.e. the hierarchical fast transcodable format is particularly well suited for the step from broadcasting (multicasting) to simulcasting, e.g. in Internet transmission.

Figure 3:
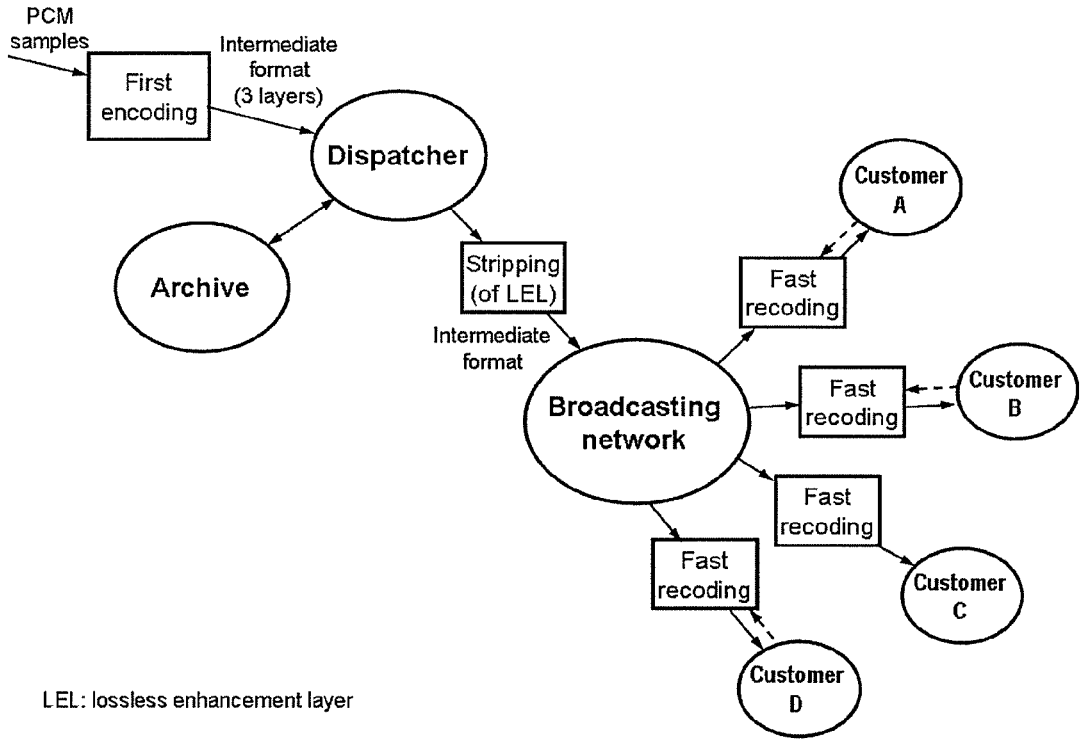
FIG. 3 usage of an intermediate audio format for broadcasting and archiving.

In FIG. 3, a broadcast/streaming server format with (optional) bit rate feedback for heterogeneous or time varying channels is shown as an application example. PCM audio samples are encoded in a first encoding step into the Intermediate Format according to the invention. Dispatcher performs further distribution to an archive and/or to customers. While the full quality signal is archived (at lower bit rate than the PCM signal), a different quality version is obtained by removing the lossless enhancement layer LEL and is fed into a broadcasting network (e.g. Internet). Before delivery to the customers, the Intermediate Format is converted into the conventionally compressed lossy audio format (e.g. mp3) by fast recoding to a desired data rate and then stripping off the new base layer BL', as described for FIG. 1 *a*), *c*) and *d*). The fast recoding operation can be placed as near as possible to the customer, e.g. in the DSL Access Multiplexer (DSLAM) for Digital Subscriber Line (DSL) transmission, or in the base station equipment for mobile radio scenarios. The DSLAM is the interface between DSL and public network.

Advantageously it is possible for the network operator to generate very late in the distribution process different versions for different customers from the same Intermediate Format signal, and it is possible for the customer to influence the encoding quality by giving feedback, as indicated in FIG. 3 by dashed arrows between Customers A,B and D to their respective recoders. Further, the flexible Intermediate Format according to the invention allows placing the recoding step (temporally and locally) near to the final customers, i.e. to a location (and time) in which the acceptable maximum data rate for each customer is known individually or can be controlled in a feedback loop. Up to this point only a single broadcast (multicast) stream containing the intermediate format is required.

Another advantage of the fast recoding process is that it provides a very flexible mechanism to address channels with quickly varying conditions, e.g. radio transmission with fast fading characteristics. The fast recoding process allows efficiently following the variations of the channel capacity by quickly adjusting the data rate of the final bit stream, if feedback on the channel characteristics is given to the re-encoder.

Figure 4:
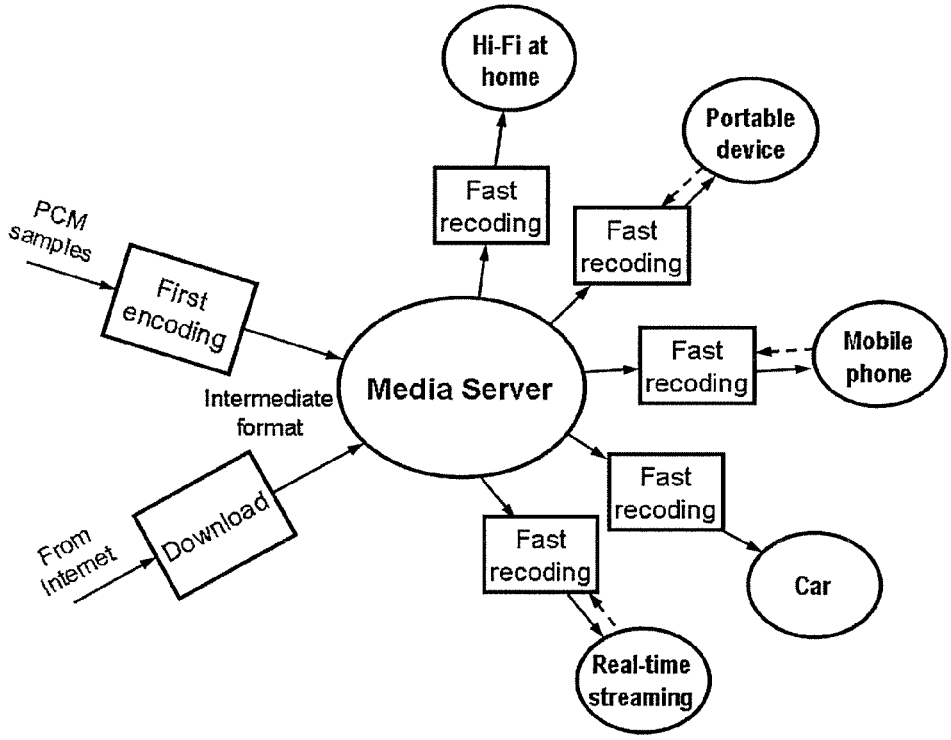
FIG. 4 usage of an intermediate audio format in a home environment.

Another example application is a Home Media Server, as shown in FIG. 4. Today's technical environment of end customers becomes more and more networked and heterogeneous. For example by using PC-based media server solutions (like Apple iTunes or Microsoft XP Media Center), archiving of the collected media data (audio, video etc) takes place in a PC environment with decreasing limitations with respect to storage capacity and computational power. Thus, a customer may want to store the media content in very high fidelity versions, though efficiently compressed. On the other hand, the customer wants to consume the media content using a large number of different devices like portable players, mobile phones (potentially with real-time streaming), Hi-Fi equipment, in the car, etc.

The Intermediate Format of the present invention can be used to build a server infrastructure that is very flexible with respect to producing bit streams with different rate-distortion tradeoffs. Storage and archiving may use the Intermediate Format, while for playback or transfer of the content to another device a recoding operation is used to produce a standard-compliant bit stream at the individually required data rate. Exemplarily, this may be about 700 Kbps for HiFi, and any data rate between 16 Kbps and 320 Kbps for an mp3 player.

Using the Intermediate Format, it is for example possible to adapt the data rate of content to be copied to a portable device with very fine granularity. Thus, the rate-distortion tradeoff can be optimally tuned to match the desired amount of content with the available storage capacity. One example is a server that has audio tracks in high quality stored, e.g. lossless quality in three layers BL,PEL,LEL or lossy quality in two layers BL,PEL. A player device may request from the server one or more audio tracks and specify a data budget according to its free storage space. The server uses a re-encoder according to the invention for encoding the audio tracks at the highest possible quality level that matches the specified data budget, and therefore may employ the player's storage capacity in an optimal manner while providing optimal audio quality to the player. The player may additionally specify a maximum quality level that it can reproduce or accept, to prevent unnecessary transmission/storage of data.

Note that the lossless enhancement layer LEL may not be needed for the above application scenarios. The embedded lossy base layer BL may be tuned to meet the data rate demands that are e.g. observed most frequently in the network to improve the recoding efficiency.

In the following, an example implementation of the Intermediate Format encoding/decoding process is described that is based on the mp3 standard plus a Parameter Enhancement Layer PEL. There is no lossless layer in this example, but such a layer may be added to the codec using the techniques described in the European Patent Application EP06113596.

Encoder

Figure 5:
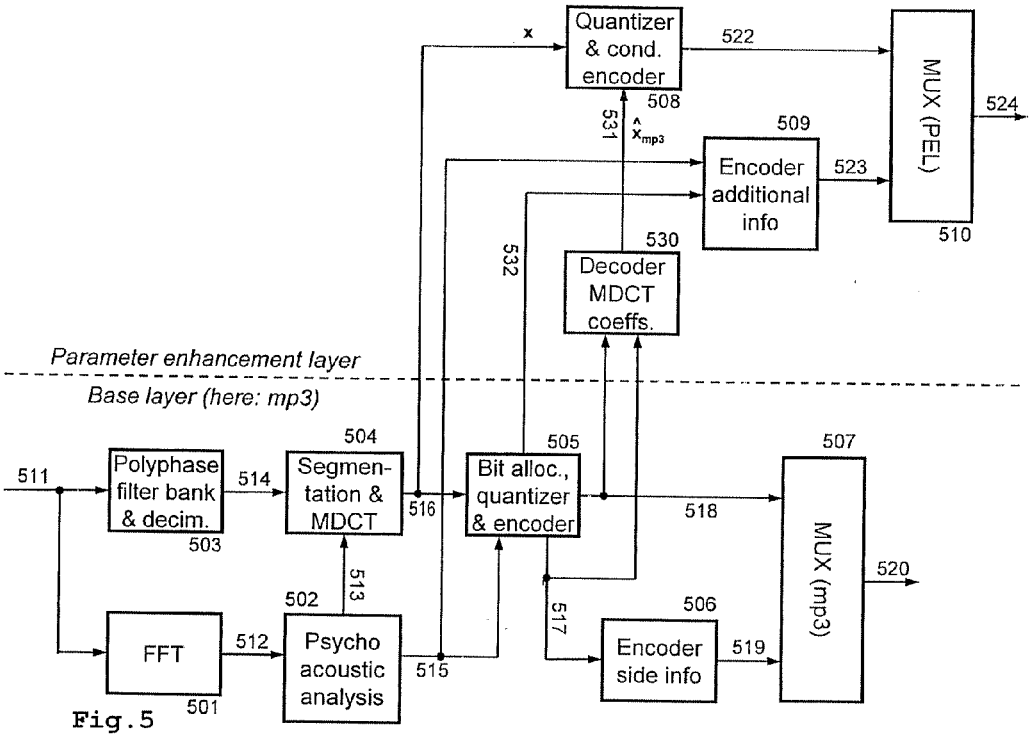

The encoder for the mp3-based Intermediate Format is depicted in FIG. 5. The signal flow exhibits two parts: the encoder of the standard-compliant mp3 bit stream 520 (lower part), and the part producing the parameter enhancement layer (PEL) bit stream 524 (upper part).

The encoder of the mp3 compliant bit stream is operating like any stand-alone mp3 encoder. The input signal 511 is first analyzed by Fast-Fourier-Transform (FFT) 501 and a psycho acoustic model 502 to provide a signal-to-mask ratio (SMR) vector 515. The FFT serves for determining masking thresholds as auxiliary data. In parallel, the input signal 511 is split into 32 sub-band signals 514 by a critically decimated (ie. operating on Nyquist edge) polyphase filter bank 503. Each of the sub-band signals is cut into segments and transformed via a Modified Discrete Cosine Transform (MDCT) 504. The core of the mp3 encoder is the bit allocation and quantization 505 of the MDCT coefficient vectors 516. Bit allocation is determined according to the SMR 515 and to the amount of bits that is available at the desired data rate. Both, the encoded transform coefficients 518 and additional side information 519, comprising e.g. scale factors, gain information etc, are combined in the conventionally formatted mp3 bit stream 520.

The parameter enhancement layer (PEL) encoder extracts information from the mp3 encoder to prepare a later re-encoding to another data rate. The main parameters to be included in the parameter enhancement layer are the MDCT coefficients 516 in fine quantization. They are conditionally quantized and encoded 508, relative to the reconstructed 530 values $\hat{x}_{mp3}$ 531 that were quantized 505 in the BL.

The conditional quantizer 508 may be implemented in the following manner. Let an arbitrary but fixed original MDCT coefficient from the vector 516 be denoted by x. $\hat{x}_{mp3,BL}$ is the reconstructed x value (within the bit allocation & quantization block 505 of the mp3 branch). Then the error of the mp3 encoder is $e_{BL}=x-\hat{x}_{mp3,BL}$ and the error of the PEL encoder is $d=x-\hat{x}_{PEL}$. $\hat{x}_{PEL}$ is generated by reconstruction of the PEL in a re-encoder. Since $\hat{x}_{PEL}$ describes the same parameters as $\hat{x}_{mp3,BL}$ (which is already available in the conventional mp3 bit stream 518), the quantization in 508 is a Conditional Quantizer. There are different possibilities to achieve the desired conditional quantization, for example two-stage quantization, i.e. the Conditional Quantizer block 508 encodes the error $e_{BL}$ of the first quantization stage 505, or conditional quantization of the prediction error.

Note that in the targeted recoding operation the MDCT coefficients from the parameter enhancement layer PEL will be used as inputs for quantization to produce the new mp3 bit stream. The reconstructed value of the re-encoded/transcoded mp3 bit stream is $\hat{x}_{mp3,final}$ with the quantization error $e_{final}=\hat{x}_{PEL}-\hat{x}_{mp3,final}$ that is generated by the quantization 607 within the transcoder. By statistical analysis it can be shown that the powers of the quantization errors of two subsequent and independent quantizers add up. This statistical behaviour is valid for the worst case where quantizers are independent from each other. That is, the total variance of the quantization error of the system, as obtained by the recoding operation will be $\mathrm{var}(x-\hat{x}_{mp3,final})=\mathrm{var}(e_{final})+\mathrm{var}(d)$. Advantageously the quality (in terms of quantization error variance) of the re-encoded signal 623 is independent from the initial quantization 505 that was done during the first encoding. It only depends on the quantization error of the conditional quantizers 508,607.

In addition to the MDCT coefficients, any other side information that is necessary to support the recoding operation will be collected and encoded 509. Examples include the full-band SMR, encoder flags etc.

Note that the additive term var(d) is independent from the choice of the quantizer in the recoding operation. This motivates that the Conditional Quantizer 508 should be parameterized such that the error variance var(d) is as low as possible, i.e. var(d)<<var($e_{final}$) so that var(d) can be neglected. On the other hand, it is clear that the quantization error variance of the MDCT coefficients in the lossy recoded mp3 bit stream will always be inferior as compared to the error variance of the MDCT coefficients in an mp3 bit stream created from the original PCM samples, namely by the additional term var(d).

Recoder

Figure 6:
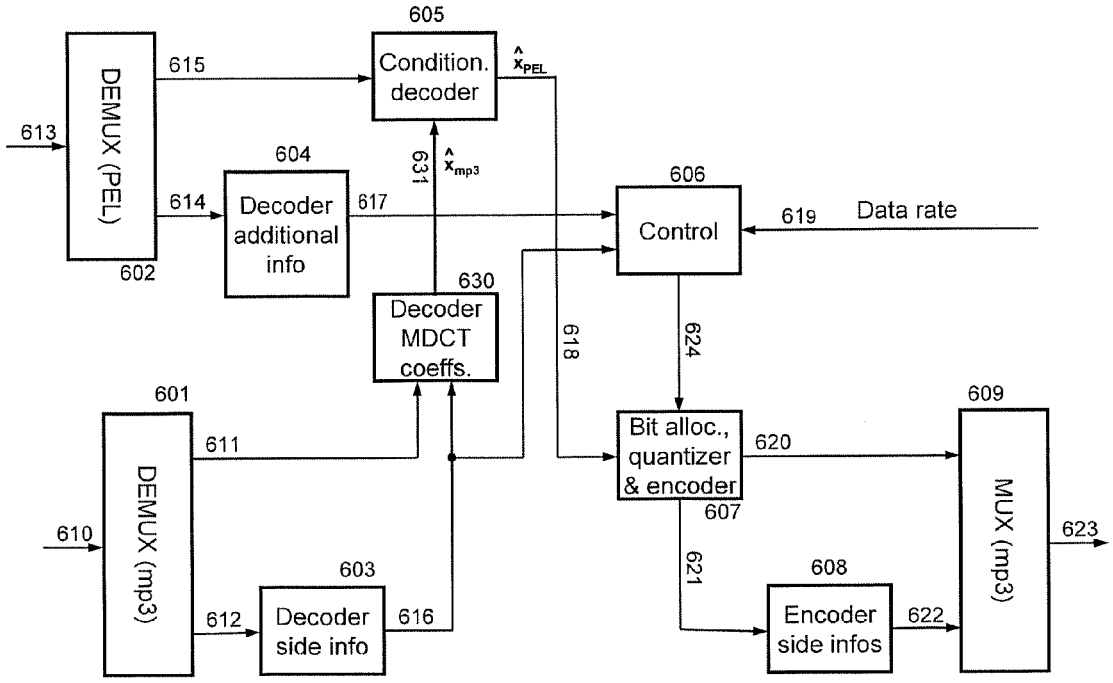

The signal flow in a recoder is exemplarily shown in FIG. 6. It reads all the information from both the parameter enhancement layer 613 and the embedded mp3 bit stream 610 to produce a new mp3 bit stream 623 with a different data rate, as described for FIG. 1 *c*).

Basically, the core of the recoding operation is the new quantization 620 of the MDCT coefficient vector, with a new bit allocation corresponding to the new desired data rate 619. Thus, the recoding operation starts by decoding the MDCT coefficients 605 and decoding 603,604 any side information that describes the old and/or new quantization process. For both processes, information from the BL and the PEL are used. A control block 606 matches the information extracted from the hierarchical bit stream 610,613 to the new encoding quality/bandwidth requirements 619. The control block 606 controls the operation of the bit allocation and quantization 607. Note that the bit allocation and quantization block 607 is basically the same block as the bit allocation and quantization block 505 in the encoder shown in FIG. 5.

For re-encoding according to FIG. 1 *d*), the re-encoder of FIG. 6 can be combined with the PEL branch encoder 508-510 of FIG. 5, wherein the conditional quantizer 508 and encoder additional information block 509 take as their inputs the output 618 of the conditional decoder 605 and the output 624 of the control block 606.

A specific advantage of the Intermediate Format for the recoding or transcoding operation is that it does not require decoding of the time domain signal. Thus, the computationally complex steps that are needed for encoding the mp3 bit stream, namely the polyphase filter bank 503, MDCT transform 504 and psycho acoustic analysis 502 (including FET 501), are not necessary for recoding. The same holds for encoding methods other than mp3: the most complex steps can be skipped during recoding, because they are performed during initial encoding and their (intermediate) output is transmitted within the parameter enhancement layer PEL.

Figure 7:
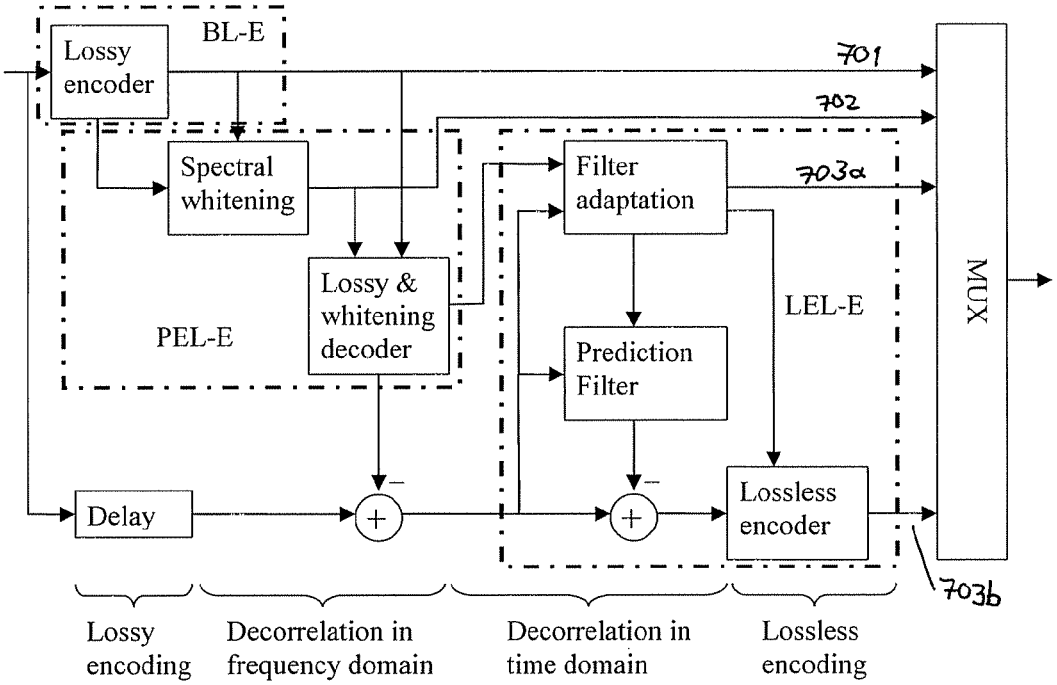

FIG. 7 shows exemplarily an encoder that provides also a lossless enhancement layer (LEL) stream 703*a*,703*b*. The bit stream 704 is here a multiplex of BL 701 PEL 702 and LEL 703*a*, 703*b*.

Figure 8:
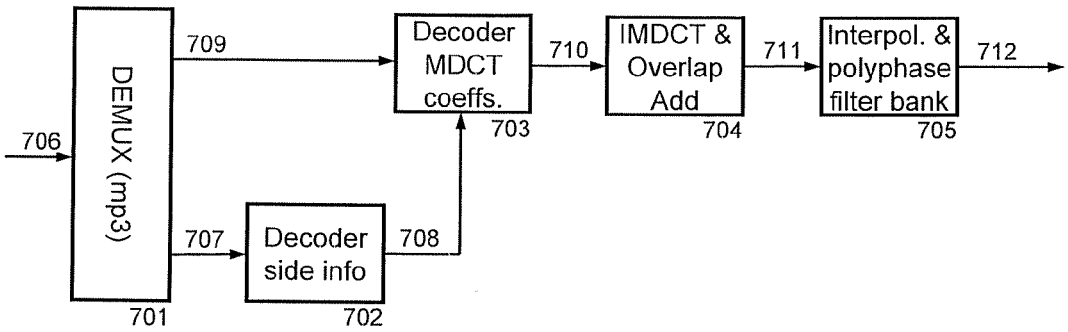
FIG. 8 the structure of a conventional mp3 decoder.

FIG. 8 shows the structure of a conventional mp3 decoder, which is also suitable for decoding a re-encoded mp3 signal after re-encoding/transcoding according to the invention. Corresponding to the encoder of FIG. 5, encoded transform coefficients 709 (corresponding to encoded transform coefficients 518) and side information 707 (corresponding to side information 519) are extracted, the MDCT coefficients $\hat{x}_{mp3,final}$ are decoded (703) and input to an inverse MDCT 704, and after an interpolation 705 the reconstructed audio signal 712 is available.

As compared to known solutions, the present invention has the following advantages.

First, only a single encoder is required. Though for each simultaneously desired data rate/quality a separate transcoder/re-encoder is required, these transcoders are of low complexity because they need not perform the complex computations of polyphase filtering, psycho-acoustic analysis, FFT etc.

Compared to bit stream scalable coding (e.g. MPEG-4 SLS), an advantage is that only two layers are used (except for lossless decoding). Bit stream scalable coding has several layers and requires separate overhead information for each of the layers. Therefore, both the intermediate and the final representation of the signal according to the invention are more compact than for today's bit stream scalable codecs. Though the recoding process according to the invention may be more complex than the simple bit dropping applied in bit stream scalable coding for adjusting the data rate, it is still advantageous because a conventional decoder can be used, and moreover the audio signal quality is higher. Thus, scalability is achievable with decoders that were not explicitly designed for this feature.

Compared to well-known feedback-controlled schemes, e.g. codecs following the adaptive multi-rate (AMR) principle, an advantage is that the feedback does not control the computationally complex complete encoding process, starting from the PCM representation of the signal. Thus, for the present invention this process needs to be performed only once.

As compared to simulcast transmission of several versions of the same signal at different data rates, the proposed scheme is more efficient in terms of data rate versus distortion.

In comparison to conventional transcoding, the invention provides higher quality of the finally delivered signal representation. Moreover, the recoding process is less complex than conventional transcoding and requires no intermediate decoding in the time-domain.

The proposed encoding scheme allows delivering the best possible quality to each customer, thus providing better quality for most users than conventional single-rate transmission.

The data format, in particular audio format, according to the invention serves primarily as Intermediate Format for re-encoding in an efficient and fast manner, for obtaining one or more derived standard complying data streams with flexible data rate.

Encoding using a method according to the invention can be performed in two steps that are inter-coordinated for cooperating, but may be locally and/or temporally separate. Between the partial encoders encoding parameters and/or auxiliary data are transmitted, which can be used by the second encoder for fast and computationally efficient implementation of the second encoding/re-encoding step.

Advantageously, the re-coding procedure can be performed without need to re-compute the analysis filter bank, the psycho-acoustic models, or other computationally expensive operations usually needed for conventional transcoding.

The invention is particularly well-suited for audio coding applications, particularly if the data rate required or accepted by the customer is not known at the time of encoding the content.

The transcoding aspect of the invention can also be applied e.g. to other scalable audio coding formats which are based on an embedded lossy bit stream, e.g. MPEG-4 SLS, whereby a plurality of higher layers contain fine quantized versions of the parameters that are used in the base layer. As mentioned above, the coding efficiency will be lower in this case as compared to the Intermediate Format according to the invention, because the plurality of higher layers requires additional overhead. However, in this case the invention has the advantage that the resulting bit stream is compliant to the format of the embedded lossy bit stream (in this example AAC), ie. no special MPEG-4 SLS decoder is required. Therefore the bit stream that is transcoded according to the invention can be decoded with a conventional ARC decoder.

The invention claimed is:

1. A method for transcoding a signal that comprises at least a first and a second data stream, wherein the first data stream is self-contained and comprises side information and a lossy encoded source signal with quantized MDCT parameters, and wherein said side information comprises data describing the quantization process by which said quantized MDCT parameters were obtained, the method comprising the steps of:

extracting from the first data stream the encoded source signal and said side information;

decoding said side information extracted from the first data stream;

decoding the extracted encoded source signal using said decoded side information, whereby decoded reconstructed parameters are obtained;

extracting from the second data stream finely quantized control parameters that were used for encoding the lossy encoded source signal, and finely quantized MDCT coefficients, wherein the finely quantized control parameters and the finely quantized MDCT coefficients are finer quantized than those extracted from the first data stream;

decoding said control parameters extracted from the second data stream;

conditionally decoding said finely quantized MDCT coefficients, wherein from said decoded reconstructed parameters at least the quantized MDCT parameters are used;

re-quantizing and re-encoding the conditionally decoded finely quantized MDCT coefficients, wherein a bit allocation algorithm is used that is controlled according to the decoded side information, the decoded encoding control parameters and a required data rate, and wherein an encoded output signal and encoded output side information are generated; and multiplexing the encoded output signal and the encoded output side information into a transcoded signal.

2. Method according to claim 1, wherein the output signal complies with the same encoding format as at least the lossy encoded source signal in said first data stream, and wherein the data rate of the output signal is different from the data rate of the first data stream.

3. Method according to claim 1, wherein the finely quantized control parameters within the second data stream are conditionally encoded relative to the encoding parameters of the first data stream.

4. An apparatus for transcoding a signal that comprises at least a first and a second data stream, wherein the first data stream is self-contained and comprises a lossy encoded source signal with quantized MDCT parameters, said side information comprising data describing the quantization process by which said quantized MDCT parameters were obtained, the apparatus comprising:

means for extracting from the first data stream the encoded source signal and said side information;

means for decoding said side information extracted from the first data stream;

means for decoding the extracted encoded source signal using said decoded side information, whereby decoded reconstructed parameters are obtained;

means for extracting from the second data stream finely quantized encoding control parameters and MDCT coefficients, wherein the finely quantized control parameters and the finely quantized MDCT coefficients are finer quantized than those extracted from the first data stream;

means for decoding said encoding control parameters extracted from the second data stream;

conditional decoder means for conditionally decoding said finely quantized MDCT coefficients, wherein from said decoded reconstructed parameters at least quantized MDCT parameter are used;

means for generating control information according to the decoded side information, the decoded additional side information and a required data rate;

means for re-quantizing and re-encoding the reconstructed parameters, wherein a bit allocation algorithm is used that is controlled according to said control information, wherein an encoded output signal and encoded output side information are generated; and means for multiplexing the encoded output signal and the encoded output side information into a transcoded signal.

5. Apparatus according to claim 4, wherein the finely quantized encoding control parameters extracted from the second data stream are conditionally encoded relative to the encoding parameters of the first data stream.

6. Apparatus according to claim 4, further comprising means for reconstructing said determined and quantized signal parameters of the lossy encoding method, wherein reconstructed values are obtained;

means for conditionally quantizing and encoding said determined signal parameters of the lossy encoding method, before said quantizing, wherein the conditional quantizing and encoding is relative to the reconstructed values, and wherein conditionally quantized and encoded signal parameters are obtained; and means for encoding also the conditionally quantized and encoded signal parameters into the second data stream.

* * * * *